US008108964B2

(12) United States Patent
Vanderlinden

(10) Patent No.: US 8,108,964 B2
(45) Date of Patent: Feb. 7, 2012

(54) SEALED PICK-UP HEAD FOR A MOBILE SWEEPER

(76) Inventor: Roger P. Vanderlinden, Burlington (CA)

( * ) Notice: Subject to any disclaimer, the term of this patent is extended or adjusted under 35 U.S.C. 154(b) by 804 days.

(21) Appl. No.: 12/238,396

(22) Filed: Sep. 25, 2008

(65) Prior Publication Data

US 2009/0089971 A1 Apr. 9, 2009

Related U.S. Application Data

(60) Provisional application No. 60/975,095, filed on Sep. 25, 2007.

(51) Int. Cl.
*A47L 9/02* (2006.01)

(52) U.S. Cl. ..... 15/331; 15/416; 15/340.1

(58) Field of Classification Search ..... 15/314, 15/331, 354, 415.1, 416, 418, 422, 340.1; *A47L 9/02*
See application file for complete search history.

(56) References Cited

U.S. PATENT DOCUMENTS 4,573,236 A * 3/1986 Dyson ..... 15/333
6,584,640 B2 * 7/2003 Vanderlinden ..... 15/418
6,588,058 B2 * 7/2003 Vanderlinden ..... 15/416

* cited by examiner

*Primary Examiner* — David Redding

(57) ABSTRACT

A sealed pick-up head for a mobile sweeper comprises a housing defining a substantially hollow interior and a suctioning bottom opening. A suctioning front opening is for receiving debris into the substantially hollow interior of the housing. A door frame surrounds the suctioning front opening. A rotatable door has at least a first door portion and a second door portion joined together at a central pivot axis, and is operatively mounted at the central pivot axis in rotatable relation on the pick-up head at the suctioning front opening. A seal is operatively disposed between the rotatable door and the door frame for sealing the rotatable door with respect to the door frame, to thereby substantially preclude air from ingressing into the substantially hollow interior of the housing through the suctioning front opening, as the rotatable door rotates to permit debris to enter the substantially hollow interior of the housing. A dust and debris outlet in the housing permits dust and debris to be suctioned from the substantially hollow interior of the housing into a hopper.

9 Claims, 6 Drawing Sheets

SEALED PICK-UP HEAD FOR A MOBILE SWEEPER

This application is a non-provisional application claiming priority from U.S. Provisional Patent Application Ser. No. 60/975,095 filed on Sep. 25, 2007, which is herein incorporated by reference.

FIELD OF THE INVENTION

The present invention relates to sidewalk sweepers and factory floor sweepers, and more particularly to pick-up heads for sidewalk sweepers and factory floor sweepers, specifically dustless pick-up heads for sidewalk sweepers and factory floor sweepers.

BACKGROUND OF THE INVENTION

Sidewalk sweepers and factory floor sweepers of various types are used to sweep debris in many different types of locations. Sidewalk sweepers are typically used to sweep sidewalks, parking lots, and so on. In use, they must sweep along curbs and the sides of buildings in order to sweep dust, dirt and debris that is adjacent to the curbs and buildings. Factory floor sweepers are typically used to sweep aisle ways in factories and warehouses, and the like.

In use, as a sidewalk sweeper or factory floor sweeper moves forwardly, dust and small debris are initially passed over by the front of the pick-up head and are suctioned into the pick-up head through its bottom opening. The bottom edge of the pick-up head at the front of the housing is only a very small distance above the surface being cleaned, perhaps one-eighth of an inch. Accordingly, only dust and very small debris can pass under it during use. This small distance between bottom edge of the pick-up head at the front of the housing and the surface being cleaned must be kept minimized in order to maintain the minimum suctioning that is necessary to suction the dust and small debris off the surface being cleaned.

Larger debris is plowed by the front of the pick-up head and must get separately suctioned up typically by a manually manipulated vacuum wand connected to the same source of vacuum on the sidewalk sweeper or factory floor sweeper that suctions air through the pick-up head. This is undesirable for a number of reasons. Accordingly, in some pick-up heads, there is a front opening that permits debris to egress into the pick-up head. A door mounted on the pick-up head at the front opening closes off air flow into the pick-up head; however, when the door opens to permit debris to egress into the pick-up head, there is a significant amount of air suctioning through the front opening. This is especially true since the debris outlet that introduces the air suctioning into the pick-up head is often located near the front opening, and often immediately behind the front opening. As a result of having a significant amount of air suctioned through the front opening, the full suctioning of the airflow that picks up the dust and small debris off the surface being cleaned is greatly reduced, thus leaving some dust and small debris on the surface being cleaned, which is unacceptable.

It is an object of the present invention to provide a pick-up head for use with a sidewalk sweeper or a factory floor sweeper.

It is another object of the present invention to provide a pick-up head for use with a sidewalk sweeper or a factory floor sweeper, wherein the full suctioning of the airflow that picks up the dust and small debris off the surface being cleaned remains when larger debris enters the pick-up head.

SUMMARY OF THE INVENTION

In accordance with one aspect of the present invention there is disclosed a novel sealed pick-up head for a mobile sweeper, the sealed pick-head comprising a housing defining a substantially hollow interior and having a front, a back, a left end and a right end, a top and a bottom, and a suctioning bottom opening for suctioning dust and small debris into the substantially hollow interior of the housing. A suctioning front opening is disposed in the front of the housing for receiving debris into the substantially hollow interior of the housing, in debris receiving relation with respect to a surface being cleaned. A door frame surrounds the suctioning front opening. A rotatable door means has at least a first door portion and a second door portion joined together at a central pivot axis, and is operatively mounted at the central pivot axis in rotatable relation on the pick-up head at the suctioning front opening. A sealing means is operatively disposed between the rotatable door means and the door frame for sealing the rotatable door means with respect to the door frame, to thereby substantially preclude air from ingressing into the substantially hollow interior of the housing through the suctioning front opening, as the rotatable door means rotates to permit debris to enter the substantially hollow interior of the housing. A dust and debris outlet in the housing permits dust and debris to be suctioned from the substantially hollow interior of the housing into a hopper.

In accordance with another aspect of the present invention there is disclosed a novel sealed pick-up head for a mobile sweeper. The sealed pick-head comprises a housing defining a substantially hollow interior and having a front, a back, a left end and a right end, a top and a bottom, and a suctioning bottom opening for suctioning dust and small debris into the substantially hollow interior of the housing. A suctioning front opening comprises an elongate tunnel disposed in the front of the housing for receiving debris into the substantially hollow interior of the housing, in debris receiving relation with respect to a surface being cleaned. A forward door means is movable between a closed position and an open position. A first sealing means is operatively disposed between the forward door means and the elongate tunnel for sealing the forward door means with respect to the elongate tunnel. A first selectively operable actuator means is for moving the forward door means between the open position and the closed position. A rearward door means is movable between a closed position and an open position. A second sealing means is operatively disposed between the rearward door means and the elongate tunnel for sealing the rearward door means with respect to the elongate tunnel. A second selectively operable actuator means is for moving the rearward door means between the open position and the closed position. The first door means and the second door means are spaced apart on from the other by a debris receiving space, to permit debris to be disposed between the first door means and the second door means. A dust and debris outlet in the housing permits dust and debris to be suctioned from the substantially hollow interior of the housing into a hopper.

In accordance with another aspect of the present invention there is disclosed a novel sealed pick-up head for a mobile sweeper. The sealed pick-head comprises a housing defining a substantially hollow interior and having a front, a back, a left end and a right end, a top and a bottom, and a suctioning bottom opening for suctioning dust and small debris into the substantially hollow interior of the housing. A suctioning front opening comprises an elongate tunnel disposed in the front of the housing for receiving debris into the substantially hollow interior of the housing, in debris receiving relation with respect to a surface being cleaned. A forward door means is movable between a closed position and an open position. A first sealing means is operatively disposed between the forward door means and the elongate tunnel for sealing the forward door means with respect to the elongate tunnel. A first biasing means biases the forward door means to the closed position. A rearward door means is movable between a closed position and an open position. A second sealing means is operatively disposed between the rearward door means and the elongate tunnel for sealing the rearward door means with respect to the elongate tunnel. A second biasing means biases the rearward door means to the closed position. A dust and debris outlet in the housing permits dust and debris to be suctioned from the substantially hollow interior of the housing into a hopper.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described herein below.

BRIEF DESCRIPTION OF THE DRAWINGS

The novel features which are believed to be characteristic of the variable width pick-up head for a mobile sweeper according to the present invention, as to its structure, organization, use and method of operation, together with further objectives and advantages thereof, will be better understood from the following drawings in which the presently preferred embodiments of the invention will now be illustrated by way of example. It is expressly understood, however, that the drawings are for the purpose of illustration and description only, and are not intended as a definition of the limits of the invention. In the accompanying drawings.

DETAILED DESCRIPTION OF THE PREFERRED EMBODIMENTS

Figure 1:
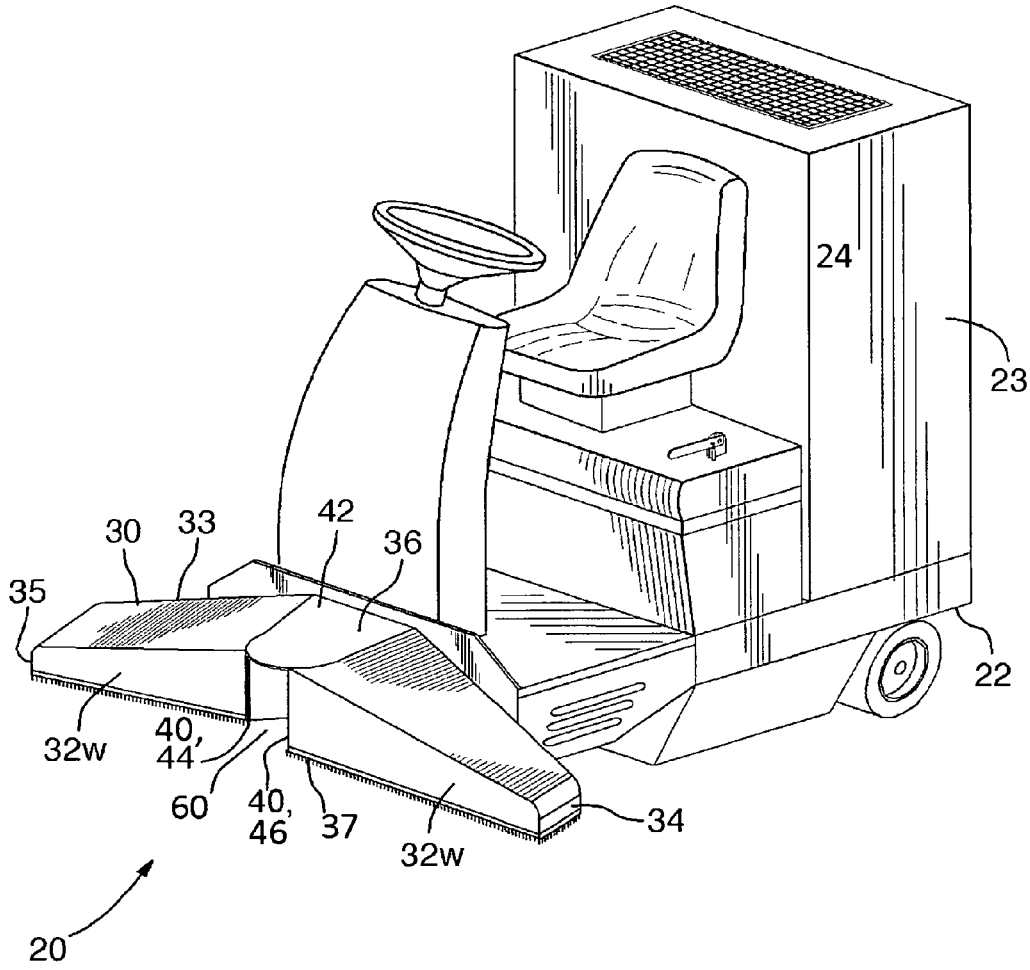
FIG. 1 is a perspective view of the first preferred embodiment of the sealed pick-up head according to the present invention, in use on a mobile sweeper vehicle.
Figure 2:
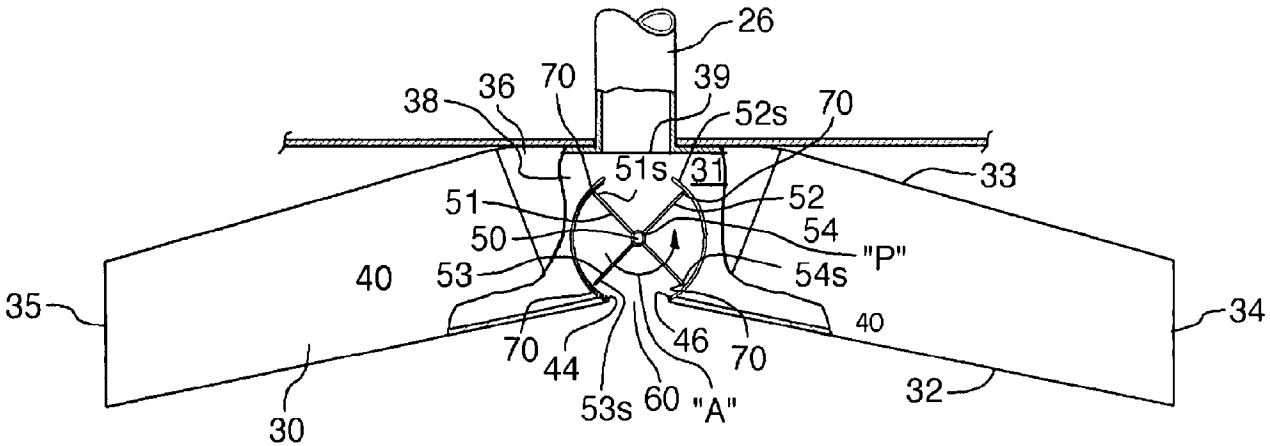
FIG. 2 is a top plan view of the first preferred embodiment sealed pick-up head of FIG. 1.
Figure 3:
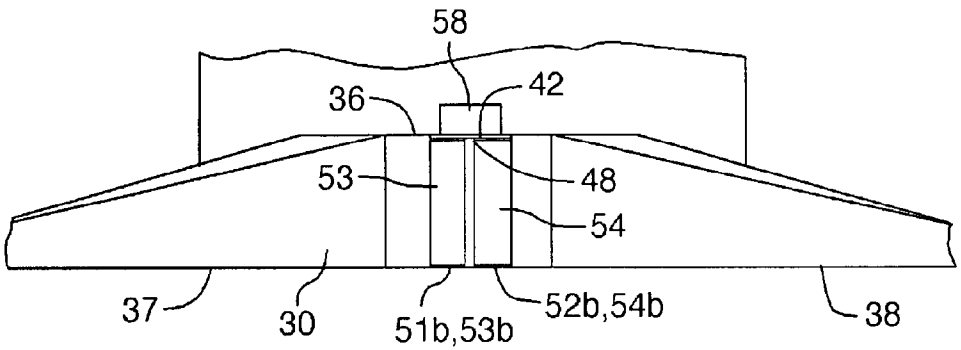
FIG. 3 is a front elevational view of the first preferred embodiment sealed pick-up head of FIG. 1.
Figure 4:
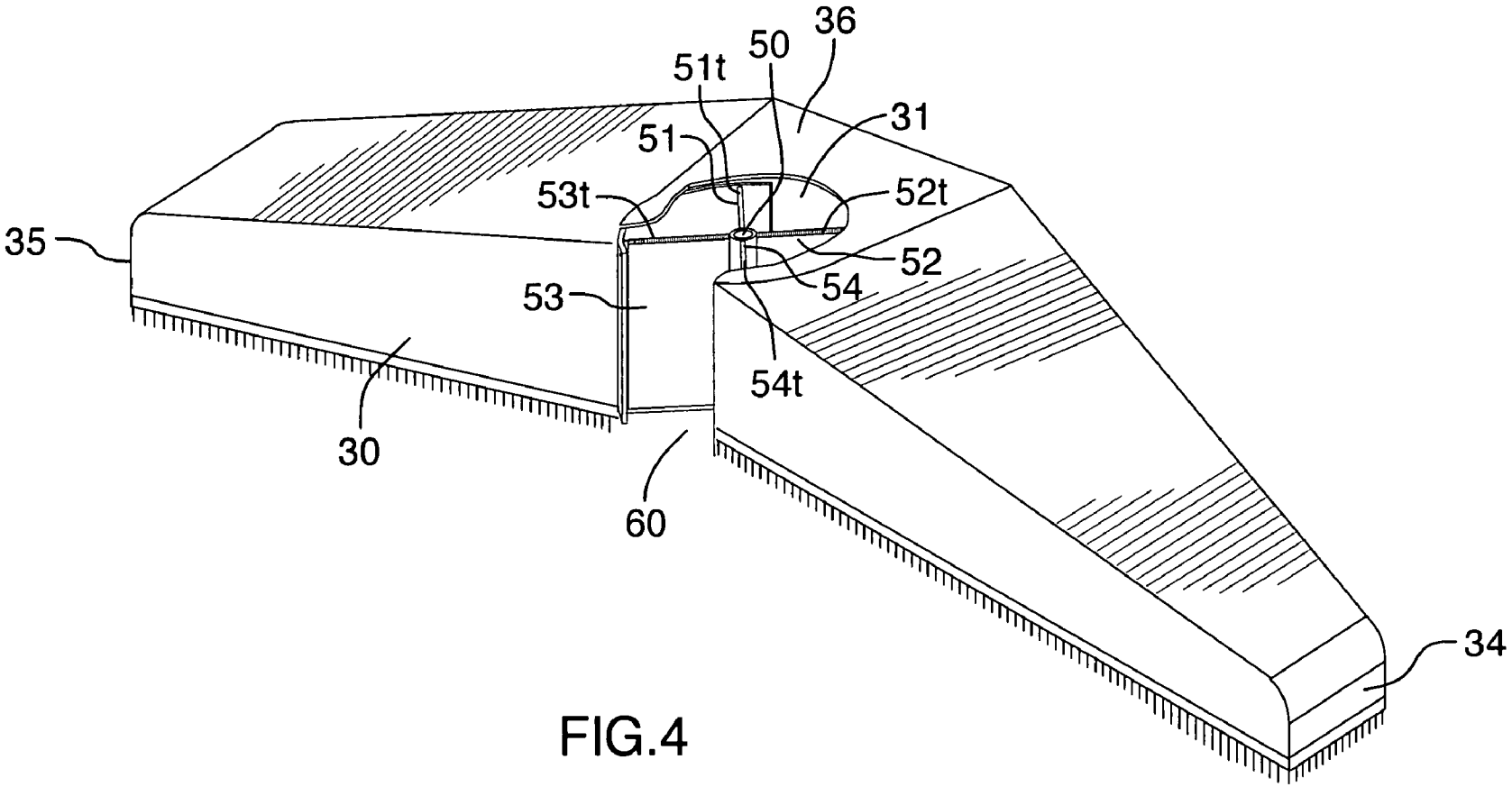
FIG. 4 is a perspective view of the first preferred embodiment sealed pick-up head of FIG. 1.
Figure 5:
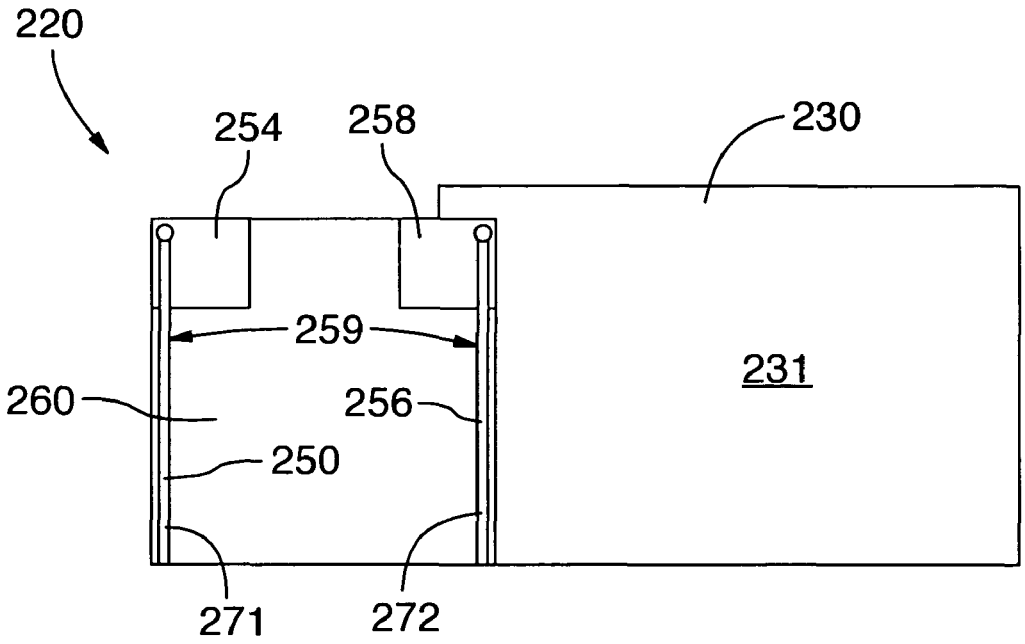
FIG. 5 is a cut-away side elevational view of the second preferred embodiment of the sealed pick-up head according to the present invention.
Figure 6:
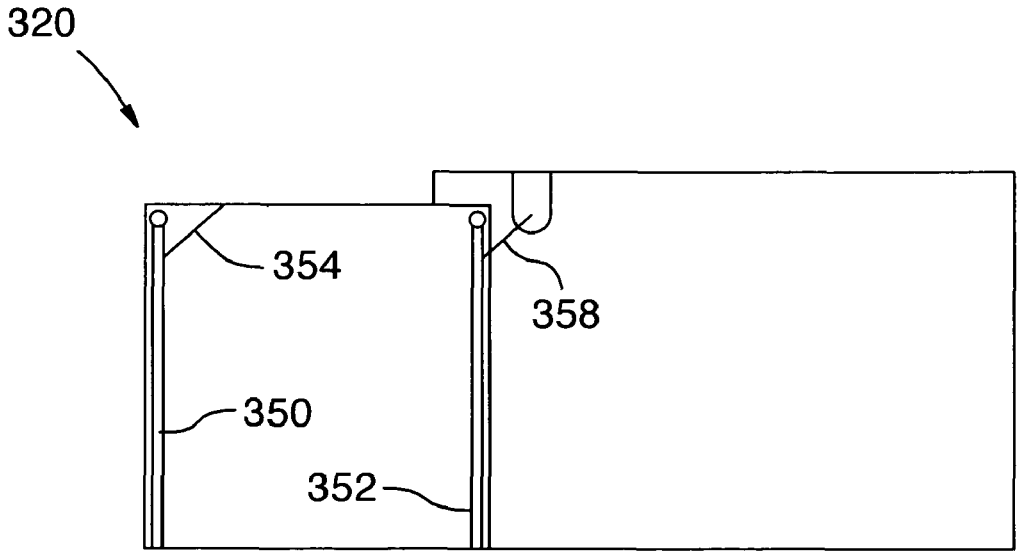
FIG. 6 is a cut-away side elevational view of the third preferred embodiment of the sealed pick-up head according to the present invention.
Figure 7:
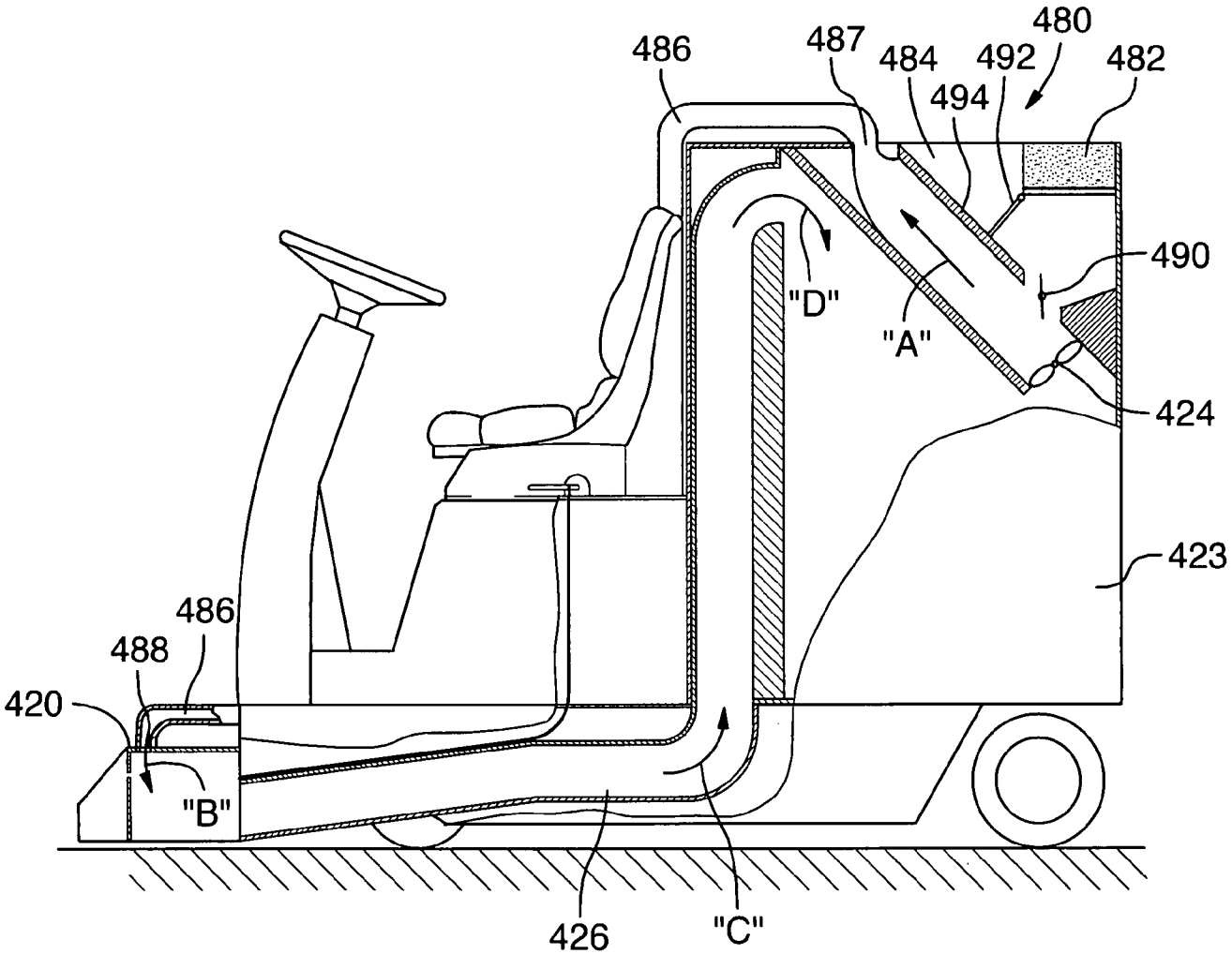
FIG. 7 is a partially cut-away side elevational view of the fourth preferred embodiment sealed pick-up head according to the present invention, in use on a mobile sweeper vehicle; and, FIG. 8 is a partially cut-away side elevational view of a portion of the fourth preferred embodiment sealed pick-up head of FIG. 6.
Figure 8:
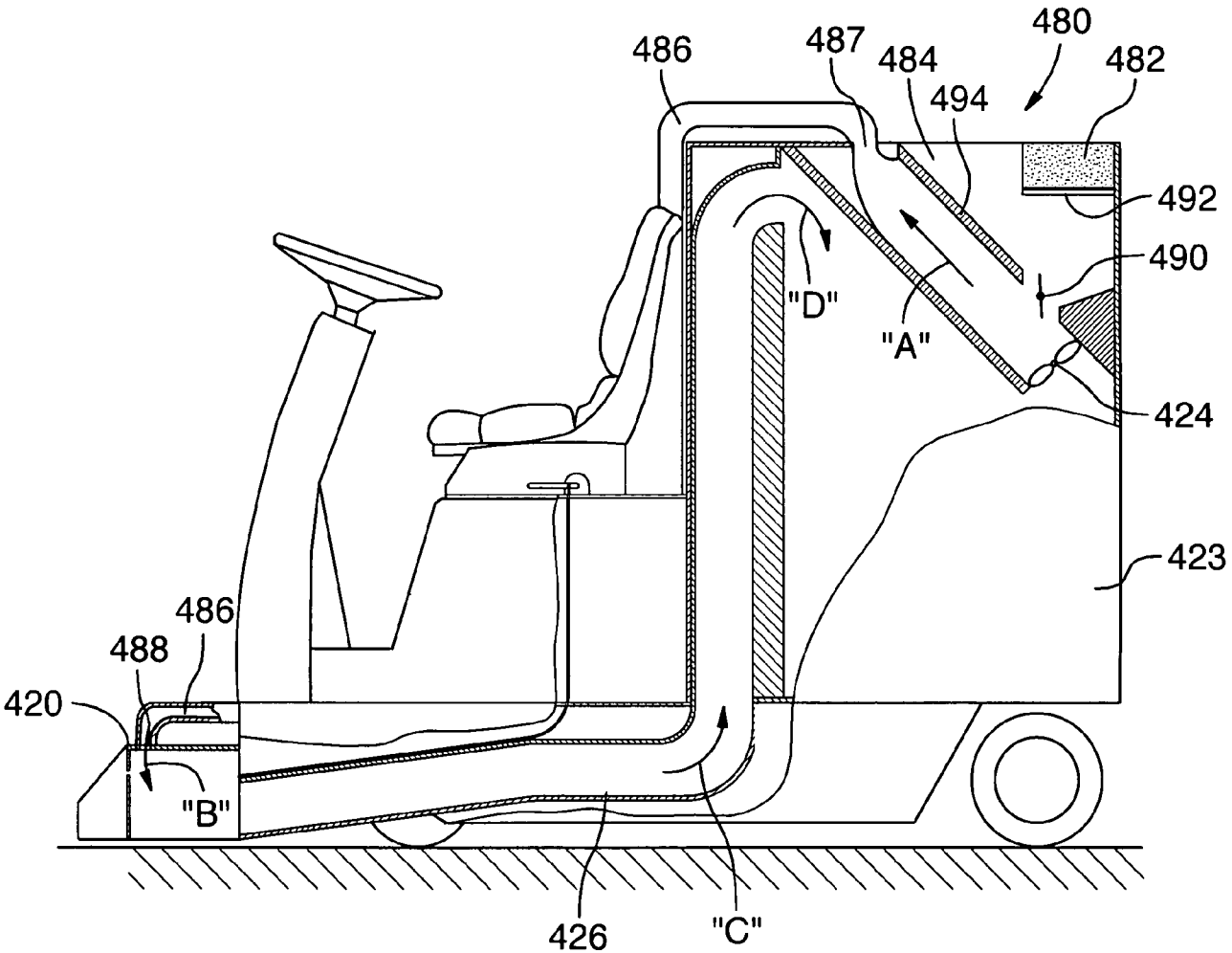

Referring to FIGS. 1 through 8 of the drawings, it will be noted that FIGS. 1 through 4 illustrate a first preferred embodiment of the pick-up head of the present invention, FIG. 5 illustrates a second preferred embodiment of the pick-up head of the present invention, FIG. 6 illustrates a third preferred embodiment of the pick-up head of the present invention, and FIGS. 7 and 8 illustrates a fourth preferred embodiment of the pick-up head of the present invention.

Reference will now be made to FIGS. 1 through 4, which show a first preferred embodiment of the pick-up head for a mobile sweeping vehicle 22 according to the present invention, as indicated by general reference numeral 20. The pick-up head 20 for a mobile sweeping vehicle 22 comprises a housing 30 defining a substantially hollow interior 31 and having a front 32, a back 33, a left end 34 and a right end 35, a top 36 and a bottom 37. There is a suctioning bottom opening 38 for suctioning dust and small debris, such as dirt and small stones, and the like, into the substantially hollow interior 31 of the housing 30.

The pick-up head 20 further comprises a suctioning front opening 60 disposed in the front of the housing 30 for receiving debris into the substantially hollow interior 31 of the housing 30, and in debris receiving relation with respect to a surface being cleaned. Preferably, the suctioning front opening 60 is disposed generally centrally in the front of the housing 30. It will also be noted that the dust and debris outlet 39 is generally centrally disposed in the back of the housing 30, so as to be generally laterally aligned with the suctioning front opening 60. The suctioning front opening 60 needs to be large enough to accept large debris, such as most sizes of cans and bottles therethrough.

The pick-up head 20 also comprises a door frame 40 surrounding the suctioning front opening 60. The door frame 40 has a ceiling portion 42 and two opposed arcuate wall portions 44, 46 that define the suctioning front opening 60. The ceiling portion 42 has a substantially planar bottom surface 48.

A rotatable door means 50 has at least a first door portion and a second door portion joined together at a central pivot axis. In the first preferred embodiment, the rotatable door means 50 has a first door portion 51, a second door portion 52, a third door portion 53 and a fourth door portion 54 joined together at a central pivot axis "P" that is preferably substantially vertically oriented. The rotatable door means is operatively mounted at the central pivot axis "P" in rotatable relation on the pick-up head at the suctioning front opening. The first door portion 51 has three outer edges, namely a top edge 51*t*, a bottom edge 51*b*, and a distal side edge 51*s*. The second door portion 52 has three outer edges, namely a top edge 52*t*, a bottom edge 52*b*, and a distal side edge 52*s*. The third door portion 53 has three outer edges, namely a top edge 53*t*, a bottom edge 53*b*, and a distal side edge 53*s*. The fourth door portion 54 has three outer edges, namely a top edge 54*t*, a bottom edge 54*b*, and a distal side edge 54*s*.

The pick-up head 20 further comprises a selectively operable actuation means for causing the rotatable door means to rotate. The selectively operable actuation means preferably comprises a hydraulic motor 58 mounted on top of the ceiling portion 42 of the door frame 40. The rotation of the hydraulic motor 58 is controlled by the operator of the mobile sweeping vehicle 22, via a suitable manually operable control. The hydraulic motor 58 rotates in a direction as indicated by arrow "A". In this manner, debris is admitted into the substantially hollow interior 31 of the housing 30 in the same direction as the relative travel of debris with respect to the pick-up head 20 as the mobile sweeping vehicle 22 travels forwardly.

There is also a sealing means 70 operatively disposed between the rotatable door means 50 and the door frame 40 for sealing the rotatable door means with respect to the door frame 40. The sealing means 70 substantially precludes air from ingressing into the substantially hollow interior 31 of the housing 30 through the suctioning front opening 60, as the rotatable door means 50 rotates to permit debris to enter the substantially hollow 31 interior of the housing 30. In the first preferred embodiment, as illustrated, the sealing means 70 comprises pliable rubber strips secured to the outer edges of each of the first door portion 51, the second door portion 52, the third door portion 53 and the fourth door portion 54. The pliable rubber strips secured to the top edges 51*t*, 52*t*, 53*t*, and 54*t* of the door portions 51, 52, 53, and 54 is in sealed sliding contact with the substantially planar bottom surface of the ceiling portion 42 of the door frame 40. The pliable rubber strip secured to the bottom edges 51*b*, 52*b*, 53*b*, and 54*b* of the door portions 51, 52, 53, and 54 is in sealed sliding contact with the surface being cleaned. The pliable rubber strip secured to the distal side edges 51*s*, 52*s* 53*s*, and 54*s* of the door portions 51, 52, 53, and 54 is in sealed sliding contact with the two opposed arcuate wall portions 44, 46 that define the suctioning front opening 60. It can be seen that at all times, at least one of the first, second, third, and fourth door portions 51, 52, 53, and 54 is in sealed sliding contact with each of the two opposed arcuate wall portions 44, 46. In the above described manner, air is substantially precluded from ingressing into said substantially hollow interior 31 of the housing 30 through the suctioning front opening 60, as the rotatable door means 50 rotates to permit debris to enter the substantially hollow interior 31 of the housing 30.

There is a dust and debris outlet 39 in the housing 30 for permitting dust and debris to be suctioned from the substantially hollow interior 31 of the housing 30 into a hopper 23 that is mounted at the back of the mobile sweeping vehicle 22, via a duct 26. Dust and debris are suctioned into the hopper 23 via a fan 24. The dust and debris outlet 39 is preferably disposed in the back 33 of the housing 30, so as to take advantage of the relative travel of debris with respect to the pick-up head 20 as the mobile sweeping vehicle 22 travels forwardly.

The pick-up head 20 further comprises means for urging large debris towards the suctioning front opening 60. In the first preferred embodiment, as illustrated, the means for urging debris towards the suctioning front opening 60 comprises a "V"-shaped front wall portion 32*w* of the housing 30. The suctioning front opening 60 is disposed at the vertex of the "V"-shaped front wall portion 32*w*, so as to receive large debris that is pushed along the left and right front walls of the housing 30, as the mobile sweeping vehicle 22 travels forwardly.

It should also be noted that the pick-up head 20 for a mobile sweeping vehicle 22 according to the present invention can be used as part of a vacuum type system on a sidewalk sweeper or a factory floor sweeper, or a re-circulating type system on a sidewalk sweeper or a factory floor sweeper.

In use, as the mobile sweeping vehicle 22 travels forwardly, dust and debris on the surface being cleaned are encountered by the pick-up head 20. As the mobile sweeping vehicle 22 moves forwardly, any debris that is encountered by the left and right front walls of housing 30 will be moved to the suctioning front opening 60, due to slope of the "V"-shaped front wall portion 32*w* of the housing 30. The debris will enter the substantially hollow interior 31 of the housing 30 through the suctioning front opening 60. Dust enters the substantially hollow interior 31 of the housing 30 via the suctioning bottom opening 38. Dust and debris that enter the substantially hollow interior 31 of the housing 30 are suctioned into the housing 30, and the suctioned out of the housing 30 through the duct 26, and into the hopper 23, by a source of suction, such as the fan 24.

More specifically, as debris reaches the suctioning front opening 60, the debris is captured between the two of the adjacent door portions of the first, second, third, and fourth door portions 51, 52, 53, and 54, which two adjacent door portions are at that time disposed at the front of the door frame 40. The operator of the mobile sweeping vehicle 22 then uses the manually operable control to rotate the hydraulic motor 58, thus causing the debris to be admitted into the substantially hollow interior 31 of the housing 30 in the same direction as the relative travel of debris with respect to the pick-up head 20 as the mobile sweeping vehicle 22 travels forwardly. As the rotatable door means 50 rotates to permit debris to enter the substantially hollow interior 31 of the housing 30, the sealing means 70 substantially precludes air from ingressing into the substantially hollow interior 31 of the housing 30 through the suctioning front opening 60. The pick-up head can therefore maintain full suctioning of the airflow that picks up the dust and small debris off the surface being cleaned remains when larger debris enters the pick-up head 30.

Reference will now be made to FIG. 5, which shows a second preferred embodiment of the sealed pick-up head according to the present invention, as indicated by reference numeral 220. The second preferred embodiment sealed pick-up head 220 is similar to the first preferred embodiment sealed pick-up head 20, except that the suctioning front opening 260 comprises an elongate tunnel 260 disposed in the front of the housing 230 for receiving debris into the substantially hollow interior 231 of the housing 230, in debris receiving relation with respect to a surface being cleaned. A forward door means 250 is movable between a closed position and an open position. A first sealing means is operatively disposed between the forward door means 250 and the elongate tunnel 260 for sealing the forward door means 250 with respect to the elongate tunnel 260. A first selectively operable actuator means comprising a first hydraulic actuator 254 is for moving the forward door means 250 between the open position and the closed position. A rearward door means 256 is movable between a closed position and an open position. A second sealing means 272 is operatively disposed between the rearward door means 252 and the elongate tunnel 260 for sealing the rearward door means 252 with respect to the elongate tunnel 260. A second selectively operable actuator means comprising a second hydraulic actuator 258 is for moving the rearward door means between the open position and the closed position. The forward door means 250 and the rearward door means 252 are spaced apart on from the other by a debris receiving space 259, to permit debris to be disposed between the forward door means 250 and the rearward door means 252.

Reference will now be made to FIG. 6, which shows a third preferred embodiment of the sealed pick-up head according to the present invention, as indicated by reference numeral 320. The third preferred embodiment sealed pick-up head 320 is similar to the second preferred embodiment sealed pick-up head 220, except that a first biasing means 354 that comprises a coil spring biases the forward door means 350 to the closed position, and a second biasing means 358 that comprises a coil spring biases the rearward door means 352 to the closed position.

It should also be noted that the pick-up head for a mobile sweeper according to the present invention can be used as part of a vacuum type system on a sidewalk sweeper or a factory floor sweeper, or as part of a re-circulating type system on a sidewalk sweeper or a factory floor sweeper, as will now be discussed.

Reference will now be made to FIGS. 7 and 8, which show a fourth preferred embodiment of the pick-up head according to the present invention, as indicated by reference numeral 420. The fourth preferred embodiment pick-up head 420 is similar to the first preferred embodiment pick-up head 20, except that it is used in a re-circulating type system on a sidewalk sweeper or a factory floor sweeper. As can be readily seen in FIGS. 7 and 8, the top covering 480 of the hopper 423 has a built in panel filter 482 at the back, and unfiltered direct opening 484 to the ambient surroundings adjacent the panel filter 482. A recirculating air hose 486 has its inlet 487 at the top covering 480 of the hopper 423 and its outlet 488 in the pickup head to form a "closed loop" system with the fan 424. The fan 424 blows unfiltered air into the inlet 487 of the recirculating air hose 486, as indicated by arrow "A". This air is introduced into the pick-up head 420, as indicated by arrow "B", in order to help capture dust and debris within the pick-up head 420. The recirculating air, including the dust and debris, circulate through the duct 426, as indicated by arrow "C", and returned to the hopper 423, as indicated by arrow "D", as drawn in by the fan 424.

A portion of the air from the fan 424 is bled off to the atmosphere, as controlled by flap valve 490, either through the panel filter 482, as is shown in FIG. 7, or through the direct opening 484, as is shown in FIG. 8. A large gate valve 492 is mounted in hinged relation at the junction between the panel filter 482 and a direct opening 484 for movement between a first position, as shown in FIG. 7, whereat all of the air flow that is bled off is directed through the panel filter 482. The large gate valve 492 seals against the slanted wall 494 in order to preclude air from escaping through the direct opening 484. This mode is used during dry sweeping in order to preclude dust from escaping to the atmosphere. There were circulation of a substantial portion of the airflow significantly reduces the volume of air that must be filtered per unit time, which is a significant problem with vacuum type sweepers.

In the event that sweeping must be performed in wet or damp conditions, there is no actual dust generated that needs to be controlled and captured; however, there is a wet airborne particulate that must be dealt with. It is well known that this wet airborne particulate can readily clog a panel filter 482. Accordingly, the large gate valve 492 can be moved to the position as shown in FIG. 8, whereat the panel filter 482 is covered, and there is a direct path for the flow of air that is bled off to the direct opening 484 to the ambient surroundings, thus precluding the panel filter 482 from becoming clogged.

As can be understood from the above description and from the accompanying drawings, the present invention provides a pick-up head for use with a sidewalk sweeper or a factory floor sweeper, wherein the full suctioning of the airflow that picks up the dust and small debris off the surface being cleaned remains when larger debris enters the pick-up head, all of which features are unknown in the prior art.

Other variations of the above principles will be apparent to those who are knowledgeable in the field of the invention, and such variations are considered to be within the scope of the present invention. Further, other modifications and alterations may be used in the design and manufacture of the pick-up head for a mobile sweeper of the present invention without departing from the spirit and scope of the accompanying claims.

I claim:

1. A sealed pick-up head for a mobile sweeper, said sealed pick-head comprising:

a housing defining a substantially hollow interior and having a front, a back, a left end and a right end, atop and a bottom, and a suctioning bottom opening for suctioning dust and small debris into said substantially hollow interior of said housing;

a suctioning front opening disposed in the front of said housing for receiving debris into said substantially hollow interior of said housing, in debris receiving relation with respect to a surface being cleaned;

a door frame surrounding said suctioning front opening;

a rotatable door means having at least a first door portion and a second door portion joined together at a central pivot axis, and operatively mounted at said central pivot axis in rotatable relation on said pick-up head at said suctioning front opening;

sealing means operatively disposed between said rotatable door means and said door frame for sealing said rotatable door means with respect to said door frame, to thereby substantially preclude air from ingressing into said substantially hollow interior of said housing through said suctioning front opening, as said rotatable door means rotates to permit debris to enter the substantially hollow interior of said housing; and, a dust and debris outlet in said housing for permitting dust and debris to be suctioned from said substantially hollow interior of said housing into a hopper.

2. The sealed pick-up head of claim 1, further comprising a selectively operable actuation means for causing said rotatable door means to rotate.

3. The sealed pick-up head of claim 2, wherein said selectively operable actuation means comprises a hydraulic motor.

4. The sealed pick-up head of claim 1, wherein said door frame surrounding said suctioning front opening has a ceiling portion and two opposed arcuate wall portions.

5. The sealed pick-up head of claim 4, wherein said ceiling portion has a substantially planar bottom surface.

6. The sealed pick-up head of claim 1, wherein said central pivot axis is substantially vertically oriented.

7. The sealed pick-up head of claim 1, wherein said suctioning front opening is disposed generally centrally in the front of said housing.

8. The sealed pick-up head of claim 1, wherein said dust and debris outlet is disposed in the back of said housing.

9. The sealed pick-up head of claim 1, wherein said dust and debris outlet is generally centrally disposed in said back of said housing.

* * * * *